US010235931B2

(12) United States Patent
Endo

(10) Patent No.: US 10,235,931 B2
(45) Date of Patent: Mar. 19, 2019

(54) TIMING CONTROLLER

(71) Applicant: ROHM CO., LTD., Ukyo-Ku, Kyoto (JP)

(72) Inventor: Hiroharu Endo, Kyoto (JP)

(73) Assignee: ROHM CO., LTD., Kyoto (JP)

( * ) Notice: Subject to any disclaimer, the term of this patent is extended or adjusted under 35 U.S.C. 154(b) by 33 days.

(21) Appl. No.: 15/422,007

(22) Filed: Feb. 1, 2017

(65) Prior Publication Data

US 2017/0221414 A1 Aug. 3, 2017

(30) Foreign Application Priority Data

Feb. 3, 2016 (JP) ..... 2016-018702
Apr. 18, 2016 (JP) ..... 2016-083131

(51) Int. Cl.

| | |
|---|---|
| ***G09G 3/3225*** | (2016.01) |
| ***G09G 3/36*** | (2006.01) |
| ***G09G 3/20*** | (2006.01) |
| ***G09G 5/22*** | (2006.01) |

(52) U.S. Cl.

CPC ..... *G09G 3/3225* (2013.01); *G09G 3/2096* (2013.01); *G09G 3/3648* (2013.01); *G09G 5/222* (2013.01); *G09G 2310/08* (2013.01)

(58) Field of Classification Search

None

See application file for complete search history.

(56) References Cited

U.S. PATENT DOCUMENTS

| | | | | |
|---|---|---|---|---|
| 4,513,282 | A * | 4/1985 | Nakagiri | G02F 1/134327 345/51 |
| 4,533,909 | A | 8/1985 | Sander | |
| 6,593,901 | B1 * | 7/2003 | Kitazawa | G04G 9/0023 345/4 |
| 6,995,779 | B1 | 2/2006 | Tanaka | |
| 2005/0177787 | A1 | 8/2005 | Yen et al. | |
| 2009/0027595 | A1 * | 1/2009 | Takahashi | G09G 3/3611 349/73 |
| 2011/0128052 | A1 * | 6/2011 | Fujibe | H04L 7/0338 327/117 |

FOREIGN PATENT DOCUMENTS

| | | | |
|---|---|---|---|
| JP | 06317782 | A | 11/1994 |
| JP | 2002169524 | A | 6/2002 |
| WO | 2007130049 | A1 | 11/2007 |

OTHER PUBLICATIONS

Extended European Search Report for corresponding to EP Patent Application No. 17153988.5-1914/3203461; dated Jul. 25, 2017.

(Continued)

*Primary Examiner* — Sarah Le

(74) *Attorney, Agent, or Firm* — Cantor Colburn LLP

(57) ABSTRACT

A main input interface receives input image data. Memory stores multiple segment data that specify the on/off states of the multiple respective segments that form a segment character on an image frame. A sub input interface receives sub data that specifies the segment character to be displayed. A segment decoder converts the segment character into a raster image based on the sub data and the multiple segment data. An image processing circuit generates output image data to be displayed on a display panel, based on at least one of the input image data and the output data of the segment decoder.

15 Claims, 12 Drawing Sheets

(56) References Cited

OTHER PUBLICATIONS

NEC Corporation: "MOS Integrated Circuit uPD16432B." Dec. 2000, pp. 1-9.
NEC Corporation: "MOS Integrated Circuit uPD16435, 16435A." Apr. 1997, pp. 1-17.
Partial European Search Report corresponding to Application No. 17153988.5-1914; dated Apr. 24, 2017.
European Office Action corresponding to Application No. 17153988.5-1210/3203461; dated Dec. 7, 2018.

* cited by examiner

CONVENTIONAL TECHNIQUE

100R

FIG. 3A
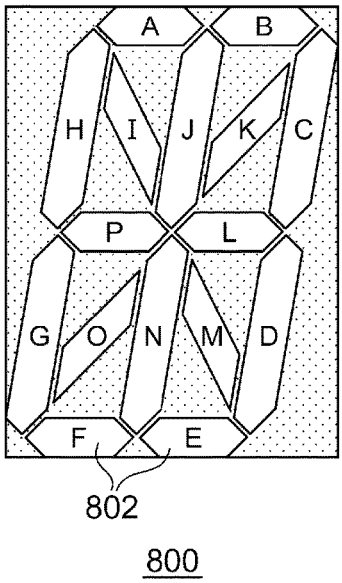
FIG. 3B
| Bit | 7 | 6 | 5 | 4 | 3 | 2 | 1 | 0 |
|---|---|---|---|---|---|---|---|---|
| Address 0 | H | G | F | E | D | C | B | A |
| Address 1 | P | O | N | M | L | K | J | I |
DATA bit 0:OFF
1:ON
FIG. 3C
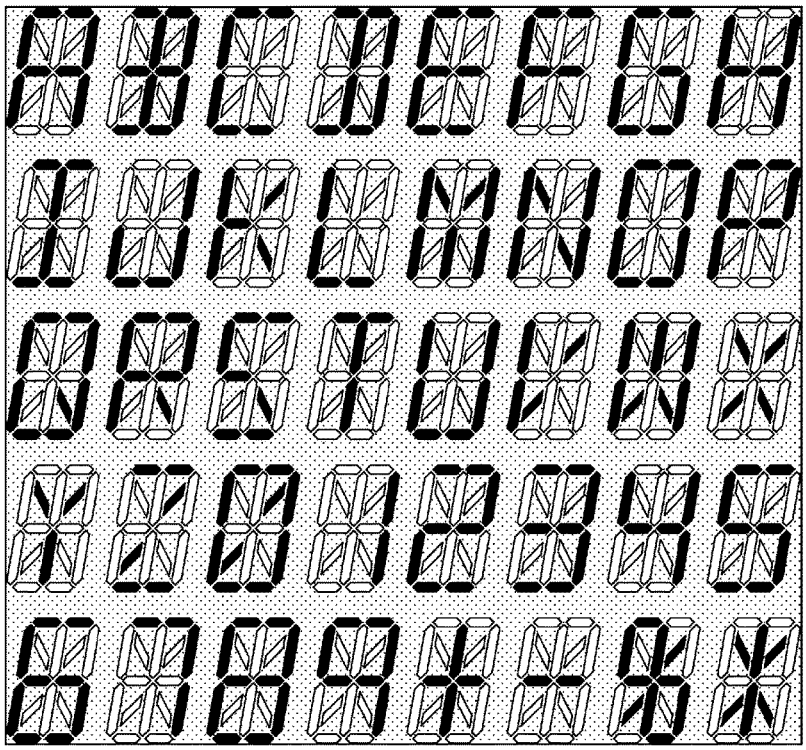

500

200a

FIG. 14A
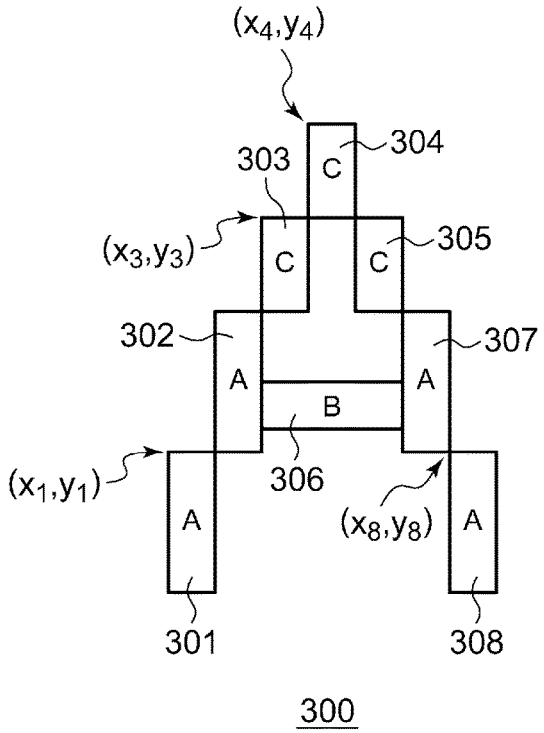
FIG. 14B
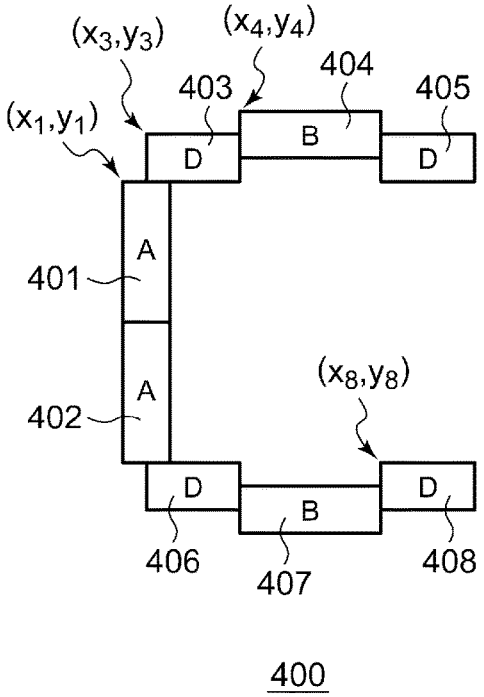
FIG. 15A
| | | TYPE | POSITION |
|---|---|---|---|
| 301 | ··· | A | $(x_1,y_1)$ |
| 302 | ··· | A | $(x_2,y_2)$ |
| 303 | ··· | C | $(x_3,y_3)$ |
| 304 | ··· | C | $(x_4,y_4)$ |
| 305 | ··· | C | $(x_5,y_5)$ |
| 306 | ··· | B | $(x_6,y_6)$ |
| 307 | ··· | A | $(x_7,y_7)$ |
| 308 | ··· | A | $(x_8,y_8)$ |
| | | S31 | S32 |
| | | $S30_{[A]}$ | |
FIG. 15B
| | | TYPE | POSITION |
|---|---|---|---|
| 401 | ··· | A | $(x_1,y_1)$ |
| 402 | ··· | A | $(x_2,y_2)$ |
| 403 | ··· | D | $(x_3,y_3)$ |
| 404 | ··· | B | $(x_4,y_4)$ |
| 405 | ··· | D | $(x_5,y_5)$ |
| 406 | ··· | D | $(x_6,y_6)$ |
| 407 | ··· | B | $(x_7,y_7)$ |
| 408 | ··· | D | $(x_8,y_8)$ |
| | | S31 | S32 |
| | | $S30_{[C]}$ | |

TIMING CONTROLLER

CROSS REFERENCE TO RELATED APPLICATIONS

The present invention claims priority under 35 U.S.C. § 119 to Japanese Application No. 2016-018702, filed Feb. 3, 2016; and to Japanese Application No. 2016-083131, filed Apr. 18, 2016, the entire content of which is incorporated herein by reference.

BACKGROUND OF THE INVENTION

1. Field of the Invention

The present invention relates to a timing controller that receives image data from a graphic controller or other devices, and that transmits information to a gate driver or a source driver.

2. Description of the Related Art

FIG. 1 is a block diagram showing an image display system. An image display system 100R includes a display panel 102 configured as a liquid crystal panel, an organic EL panel or the like, a gate driver 104, a source driver 106, a graphic controller 110, and a timing controller 200R. The graphic controller 110 generates image data to be displayed on the display panel 102. The image data includes pixel (RGB) data in the form of serial data, which is transmitted to the timing controller 200R.

The timing controller 200R receives the image data, and generates various kinds of control signals and timing signals (synchronization signals). The gate driver 104 sequentially switches the selected scanning line from among the scanning lines $L_S$ of the display panel 102 in synchronization with a signal received from the timing controller 200R. Furthermore, the RGB data is supplied to the source driver 106.

Typically, the timing controller 200R and the graphic controller 110 are coupled via a differential serial interface. Before a link is established via the serial interface between the timing controller 200R and the graphic controller 110, image data transmission cannot be performed after the image display system 100R is started up. Accordingly, in this period of time, the display panel 102 cannot display an image. Also, if link disconnection occurs due to noise or the like after the link has been established, the display panel 102 cannot display an image before the link is established again.

Also, if a corresponding cable is unplugged or disconnected, or otherwise if a malfunction occurs in a part of the serial interface or the graphic controller 110, the same problem occurs. In the present specification, such a problem state in which an image display operation cannot be performed will be referred to as the "display inoperative state".

With conventional techniques, in some cases, the timing controller 200R is provided with an implemented function for displaying given information on the display panel 102 in the display inoperative state. For example, the timing controller 200R stores a predetermined failsafe display pattern 201. Examples of such a display pattern 201 includes a color bar image, a monotone screen image, and the like. With such an arrangement, in the display inoperative state, the timing controller 200R transmits such a failsafe display pattern 201 to the source driver 106 as a substitution for the image data to be received from the graphic controller 110.

As a result of investigating such an image display system 100R shown in FIG. 1, the present inventor has come to recognize the following problem. The image display system 100R shown in FIG. 1 is capable of preventing the occurrence of an complete blackout state in the display panel 102 even in the display inoperative state. However, the pattern 201 to be displayed in this state is required to be determined in a design stage for the image display system 100R. That is to say, such an arrangement is not capable of displaying useful information in a real-time manner.

SUMMARY OF THE INVENTION

The present invention has been made in order to solve such a problem. Accordingly, it is an exemplary purpose of an embodiment of the present invention to provide a timing controller that is capable of displaying useful information on a display panel in a real-time manner both in the display inoperative state and in a normal state.

An embodiment of the present invention relates to a timing controller. The timing controller comprises: a main input interface structured to receive input image data; memory structured to store multiple segment data that correspond to multiple respective segments that form a segment character, wherein each segment data is structured to specify on/off states of pixels that correspond to the corresponding segment on an image frame; a sub input interface structured to receive sub data that specifies the segment character to be displayed; a segment decoder structured to generate the segment character in the form of a raster image based on the sub data of the multiple segments and the multiple segment data; an image processing circuit structured to generate output image data to be displayed on a display panel, based on at least one from among the input image data and output data of the segment decoder; and an output interface structured to output the output image data to a data driver.

Such an embodiment is capable of displaying, on a display panel, information using desired segment characters specified by the sub data in a real-time manner, instead of or in addition to a display pattern determined beforehand. By employing such segment characters, such an arrangement is not required to store bitmap information with respect to multiple alphabetic and numeric characters. Thus, such an arrangement requires only small-scale memory on the timing controller side.

In the present specification, examples of such "segment characters" include dot-matrix characters each formed of multiple dots, in addition to 16-segment characters, 14-segment characters, and 7-segment characters.

Also, the segment decoder may comprise: a multiplexer structured to receive a first luminance value that specifies the color of the segment character and a second luminance value that specifies the color of the background, and to select one from among the first luminance value and the second luminance value thus received; and a timing generator structured to control the multiplexer according to the sub data and the segment data.

Such an arrangement requires only a simple configuration to convert such a segment character into a raster image.

Also, the image processing circuit may select one from among the input image data and the output data of the segment decoder so as to generate the output image data.

This allows information to be displayed using such segment characters when an image cannot be displayed.

Also, the image processing circuit may be structured to combine the input image data and the output data of the segment decoder so as to generate the output image data.

This allows the information to be displayed using such segment characters in a normal state, in addition to an abnormal state in which an image cannot be displayed.

Also, the image processing circuit may be structured to switch between: (i) a mode in which data is selected from among the input image data and the output data of the segment decoder so as to generate the output image data; and (ii) a mode in which the input image data and the output data of the segment decoder are combined so as to generate the output image data.

Also, the segment character may comprise multiple segments designed such that two or more segments have a common shape. Also, the segment data of the aforementioned two or more segments having the common shape may comprise shape data that specifies the shape of the segment and data that specifies the shift amount by which the segment is to be shifted.

This allows the data amount of the segment data to be dramatically reduced, thereby allowing the circuit area of the timing controller to be reduced.

Also, the sub data may comprise multiple bits that specify the on/off states of the multiple respective segments.

This allows such a segment character to be freely designed, which allows a user to employ original characters.

Also, the sub data may comprise a character code that specifies the segment character. Also, the timing controller may further comprise a character decoder structured to convert the character code into multiple bits that specify the on/off states of the multiple respective segments.

In this case, such an arrangement requires the user to specify only the character code to be displayed, without giving consideration to the shape of the segment or the like.

Also, the sub data may further comprise first data that specifies the size of the segment character. The memory may store the segment data for each size. Such an arrangement provides improved visibility. Also, such an arrangement allows the amount of information to be increased. For example, such an arrangement provides a manner of use in which the font size, etc., is changed according to the priority of the information.

Also, the sub data may further comprise second data that specifies an interval between segment characters. Such an arrangement provides improved visibility.

Also, the sub data may further comprise an indication of transparency of the segment character.

Also, the sub input interface may be configured as an SPI (Serial Peripheral Interface) or otherwise an $I^2C$ (Inter-Integrated Circuit) interface. Such interfaces have been widely distributed as typical interfaces. Such an arrangement allows the sub input interface to be mounted in a simple manner.

With an embodiment, the timing controller may be monolithically integrated on a single semiconductor substrate.

Examples of such a "monolithically integrated" arrangement include: an arrangement in which all the circuit components are formed on a semiconductor substrate; and an arrangement in which principal circuit components are monolithically integrated. Also, a part of the circuit components such as resistors and capacitors may be arranged in the form of components external to such a semiconductor substrate in order to adjust the circuit constants.

Another embodiment of the present invention relates to an electronic device. The electronic device may comprise any one of the aforementioned timing controllers.

Yet another embodiment of the present invention relates to an in-vehicle display apparatus or otherwise as a medical display apparatus. Such a display apparatus may comprise any one of the aforementioned timing controllers.

It is to be noted that any arbitrary combination or rearrangement of the above-described structural components and so forth is effective as and encompassed by the present embodiments. Moreover, this summary of the invention does not necessarily describe all necessary features so that the invention may also be a sub-combination of these described features.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which:

FIGS. 3A through 3C are diagrams for explaining a segment character;

FIGS. 14A and 14B are diagrams each showing a segment character according to an eighth modification;

FIG. 15A is a diagram showing description data that represents the segment character shown in FIG. 14A, and FIG. 15B is a diagram showing description data that represents the segment character shown in FIG. 14B.

DETAILED DESCRIPTION OF THE INVENTION

The invention will now be described based on preferred embodiments which do not intend to limit the scope of the present invention but exemplify the invention. All of the features and the combinations thereof described in the embodiment are not necessarily essential to the invention.

In the present specification, the state represented by the phrase "the member A is coupled to the member B" includes a state in which the member A is indirectly coupled to the member B via another member that does not affect the electric connection therebetween, in addition to a state in which the member A is physically and directly coupled to the member B.

Similarly, the state represented by the phrase "the member C is provided between the member A and the member B" includes a state in which the member A is indirectly coupled to the member C, or the member B is indirectly coupled to the member C via another member that does not affect the electric connection therebetween, in addition to a state in which the member A is directly coupled to the member C, or the member B is directly coupled to the member C.

Figure 1:
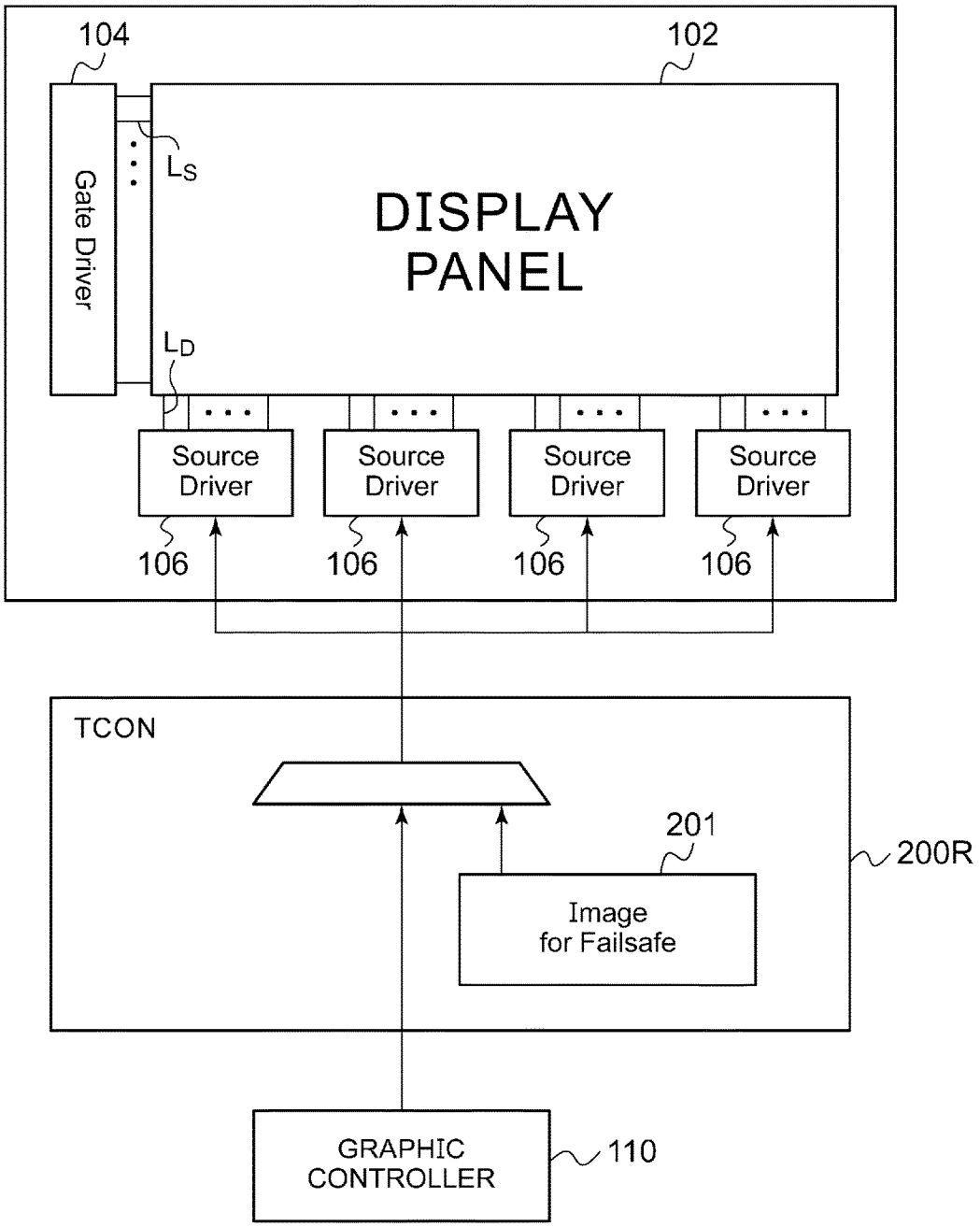
FIG. 1 is a block diagram showing an image display system.
Figure 2:
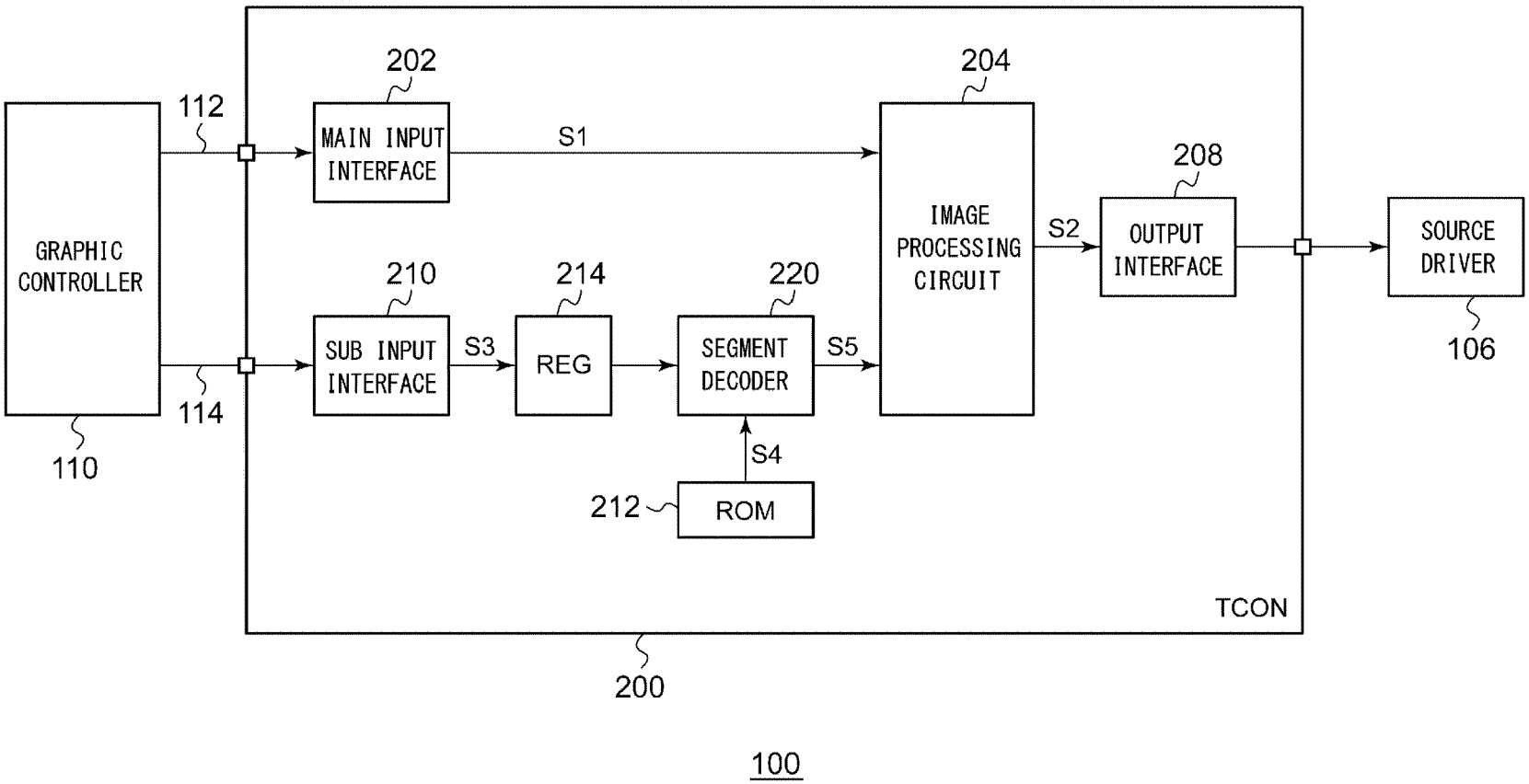
FIG. 2 is a block diagram showing a timing controller according to an embodiment.

FIG. 2 is a block diagram showing a timing controller 200 according to an embodiment. The timing controller 200 receives input image data from the graphic controller 110, supplies output image data to the source driver 106, and supplies control signals and synchronization signals to the gate driver 104 and the source driver 106, in the same way as the image display system 100R shown in FIG. 1. The timing controller 200 may be configured as a function IC integrated on a single semiconductor substrate.

The timing controller 200 includes a main input interface 202, an image processing circuit 204, an output interface circuit 208, a sub input interface 210, memory 212, and a segment decoder 220.

The main input interface 202, the image processing circuit 204, and the output interface circuit 208 form a circuit block that relates to a display operation for the image data received from the graphic controller 110. Such a circuit block may have the same configuration as that included in the timing controller 200R according to a conventional technique. The main input interface 202 is coupled to the graphic controller 110 via a first line 112, and receives input image data S1. As an interface that couples the main input interface 202 and the graphic controller 110, a high-speed differential serial interface such as an LVDS (Low Voltage Differential Signaling) may be employed.

The image processing circuit 204 performs various kinds of signal processing on the input image data S1 received via the main input interface 202. The signal processing provided by the image processing circuit 204 is not restricted in particular. That is to say, known techniques may be employed. Examples of such image processing include gamma correction, FRC (Frame Rate Control) processing, RGB mapping, and the like. After the image processing circuit 204 performs the image processing, the output interface circuit 208 outputs the output image data S2 thus subjected to the image processing to the source driver 106.

The above is the basic configuration of the timing controller 200. The timing controller 200 is capable of displaying an image (which will be referred to as a "sub image" hereafter) based on sub data S3 instead of or otherwise in addition to an image (which will be referred to as a "main image" hereafter) based on the input image data S1. In connection with the display operation for such a sub image, the timing controller 200 includes the sub input interface 210, the memory 212, and the segment decoder 220.

The sub image is generated using segment characters. FIGS. 3A through 3C are diagrams for explaining such a segment character. A segment character 800 is displayed in the form of an on/off combination of multiple segments 802. FIG. 3A shows a 16-segment character. Identifiers A through P are respectively assigned to the sixteen segments 802 for convenience. FIG. 3B shows an example of a code for representing such a 16-segment character. Such a 16-segment character can be represented by 16-bit data, i.e., 2-byte data. Accordingly, a register (214 in FIG. 2) having a data capacity of 2 bytes may preferably be provided for each character, which allows a letter or a symbol to be uniquely specified.

FIG. 3C shows examples of characters represented by such a 16-segment character. Specifically, FIG. 3C shows character examples including upper-case letters of the alphabet, Arabic numerals, and other symbols such as "+", "–", "#", and "*". In addition, such an arrangement is capable of representing other characters, examples of which include lower-case letters of the alphabet, Greek numerals, other symbols, Japanese hiragana characters, Japanese katakana characters, Chinese characters, and other characters for other languages.

Returning to FIG. 2, the sub input interface 210 is coupled to the graphic controller 110 via a second line 114 that is independent of the first line 112. As such a sub input interface 210, a register access-type interface such as an SPI (Serial Peripheral Interface), an $I^2C$ interface, or the like, may be employed.

The graphic controller 110 generates the sub data S3 that indicates a segment character to be displayed on the display, instead of or otherwise in addition to the input image data S1. The sub input interface 210 receives the sub data S3 via the second line 114. It should be noted that the independence between the first line 112 and the second line 114 allows the sub input interface 210 to receive the sub data S3 from the graphic controller 110 even in a state in which a malfunction has occurred in the first line 112 or even before a link is established between the main input interface 202 and the graphic controller 110 when the system is started up.

Figure 4B:
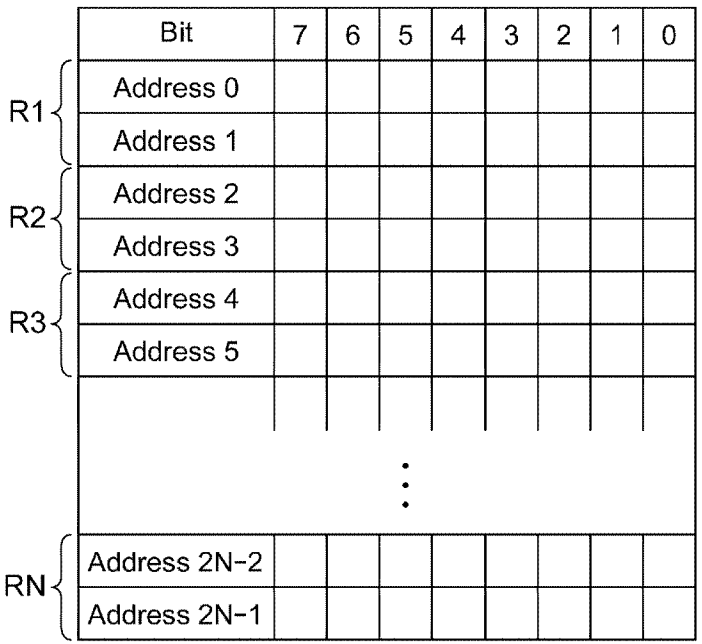
FIG. 4B is a diagram showing an example of an address map of a register.
Figure 4A:
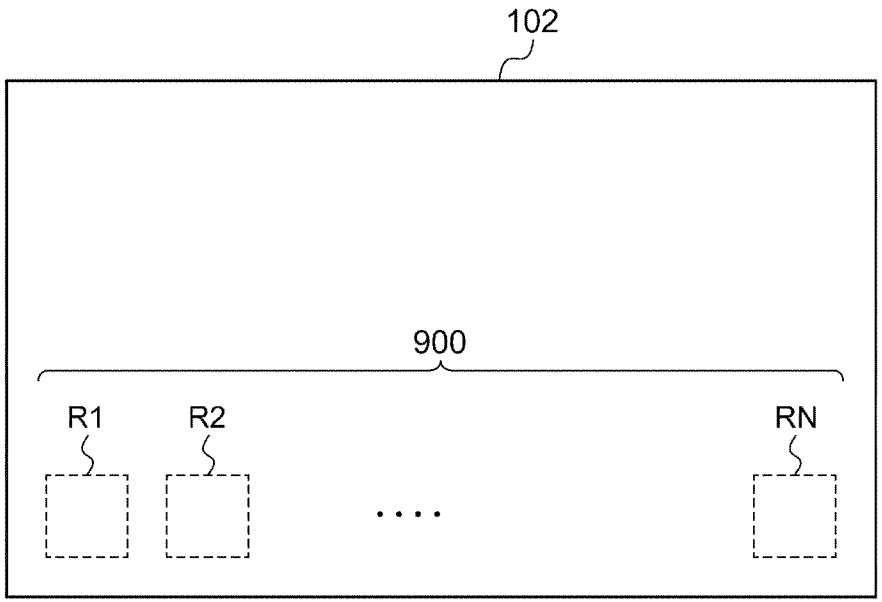
FIG. 4A is a diagram showing an example of a sub image.

FIG. 4A is a diagram showing an example of a sub image 900. The sub image 900 displayed on the display panel 102 may include multiple segment characters 800. For simplicity of description and ease of understanding, description will be made assuming that the sub image 900 has fixed regions R1 through RN each of which is capable of displaying a segment character 800. Accordingly, the sub data S3 has no information that specifies the positions of the regions R1 through RN. The sub data S3 specifies the character to be displayed for each region R.

Description will be made in the present embodiment regarding an arrangement in which the sub data S3 includes multiple bits (16 bits=2 bytes in this example) for each character, which respectively indicate the on/off states of the multiple segments 802 (A through P) assigned for each character. Such an arrangement allows the user of the timing controller 200 to freely display a desired character.

FIG. 4B is a diagram showing an example of an address map held by the register 214. For example, the register of the sub input interface 210 has a 2-byte address area assigned for each region R. For example, the address areas 0 to 1 correspond to the region R1, and the address areas 2 to 3 correspond to the region R2. The graphic controller 110 writes a value that indicates a character to be displayed, i.e., the sub data S3, to the address that corresponds to each region R.

The memory 212 stores multiple segment data $S4_A$ through $S4_P$ that each indicate the on/off states of the pixels on the image frame with respect to the corresponding one of the multiple segments (A through P in FIG. 3A). The memory 212 may be configured as nonvolatile memory such as ROM (Read Only Memory) or the like. For example, the segment data $S4_A$ represents the on/off state of the segment A, and the segment data S4B represents the on/off state of the segment B. Detailed description will be made later regarding the segment data S4.

The segment decoder 220 generates a raster image of the segment character 800 to be displayed (conversion into a bitmap format) based on the sub data S3 and the multiple segment data S4. The segment decoder 220 outputs output data S5 in the form of image data (sub image data) of the segment character 800 specified by the sub data S3.

The image processing circuit 204 receives, as input data, the input image data S1 and the sub image data S5 generated by the segment decoder 220. The image processing circuit 204 generates the output image data S2 to be displayed on the display panel, based on the input image data S1 and the sub image data S5.

Various kinds of operations and configurations are conceivable for the image processing circuit 204.

Figure 5A:
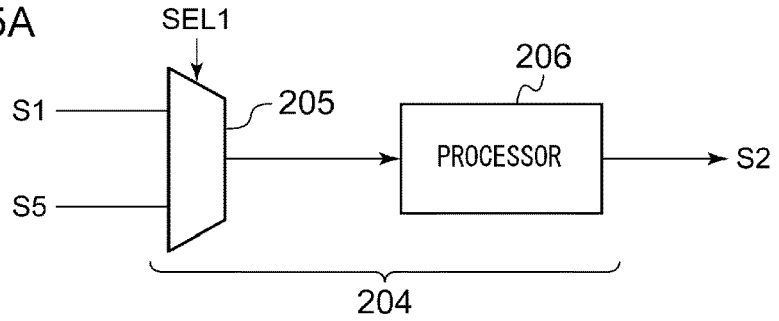
FIG. 5A is a block diagram showing an example configuration of an image processing circuit.

For example, (i) the image processing circuit 204 may select one from among the input image data S1 and the sub image data S5 so as to generate the output image data S2. FIG. 5A is a block diagram showing an example configuration of the image processing circuit 204. The image processing circuit 204 may include a multiplexer 205 configured as an input stage to receive the input image data S1 and the sub image data S5, and to select one from among them according to a control signal SEL1. A processor 206 configured as a downstream stage performs predetermined signal processing on the image data selected by the multiplexer 205. Before a link is established between the main input interface 202 and the graphic controller 110, the image processing circuit 204 may select the sub image data S5. Also, when a malfunction has occurred in the interface that couples the main input interface 202 and the graphic controller 110, the image processing circuit 204 may select the sub image data S5. When the input image data S1 is input normally, the image processing circuit 204 selects the input image data S1. Alternatively, the image processing circuit 204 may select one from among the input image data S1 and the sub image data S5 according to the control data received from the graphic controller 110.

Figure 5B:
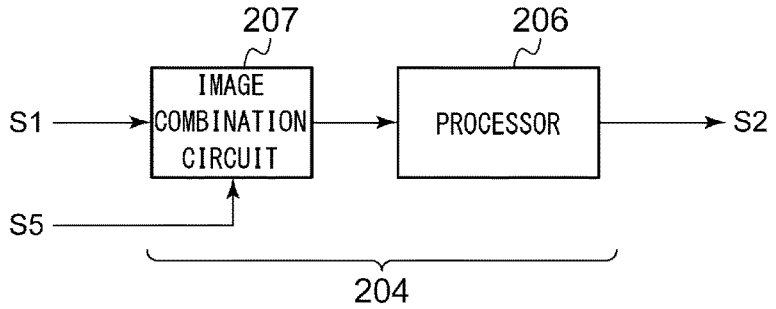
FIG. 5B is a block diagram showing an example configuration of the image processing circuit.

(ii) Also, the image processing circuit 204 may combine the input image data S1 and the sub image data S5 so as to generate the output image data S2. FIG. 5B is a block diagram showing an example configuration of the image processing circuit 204. The image processing circuit 204 may include an image combination circuit 207 that combines the input image data S1 and the sub image data S5. Examples of such image combination processing include alpha blending and the like. Also, the sub image data S5 is displayed on the regions R1 through RN on which the sub image 900 shown in FIG. 4A is to be displayed. In addition, the input image data S1 may be displayed in the other regions. The processor 206 performs predetermined signal processing on the image thus generated by the image combination circuit 207.

Also, the main input interface 202 may be configured to be switched between a mode in which the image data to be displayed is selected from among the input image data S1 and the sub image data S5 and a mode in which the input image data S1 and the sub image data S5 are combined. That is to say, both the functions shown in FIGS. 5A and 5B may be implemented.

The timing controller 200 according to the embodiment allows the display panel 102 to display information using desired segment characters specified in a real-time manner according to the sub data S3, instead of or in addition to a predetermined display pattern as shown in FIG. 1.

Furthermore, the timing controller 200 is configured to employ such segment characters. In a case in which bitmap information is held for each of multiple alphabetic and numeric characters, e.g., in a case in which each character is represented by (X×Y)-pixel data, such an arrangement requires (X×Y)-bit bitmap data for each character, which requires a very large memory capacity. In contrast, the present embodiment requires the timing controller to have only a small memory capacity.

The present invention encompasses various kinds of apparatuses and circuits that can be regarded as a block configuration or a circuit configuration shown in FIG. 2, or otherwise that can be derived from the aforementioned description. That is to say, the present invention is not restricted to a specific circuit configuration. More specific description will be made below regarding an example configuration for clarification and ease of understanding of the essence of the present invention and the circuit operation. That is to say, the following description will by no means be intended to restrict the technical scope of the present invention.

Figure 6:
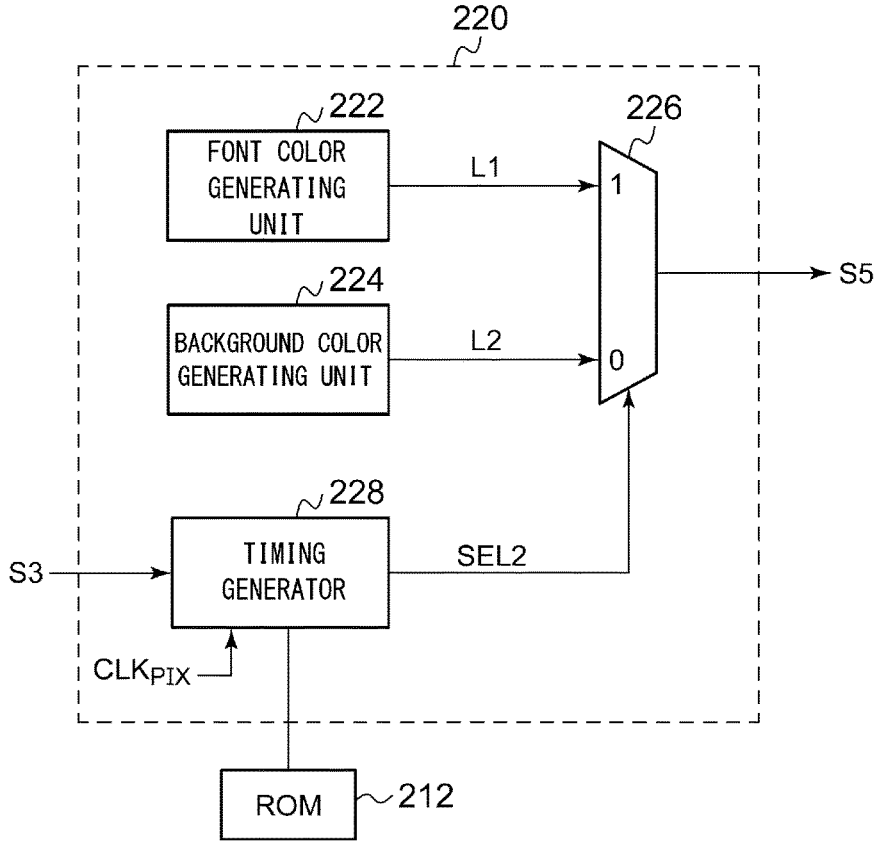
FIG. 6 is a block diagram showing an example configuration of a segment decoder.

FIG. 6 is a block diagram showing an example configuration of the segment decoder 220. The segment decoder 220 includes a font color generating unit 222, a background color generating unit 224, a multiplexer 226, and a timing generator 228. The font color generating unit 222 generates a first luminance value L1 that indicates the color (font color) of the segment character 800. The background color generating unit 224 generates a second luminance value L2 that indicates the background color. The multiplexer 226 receives the first luminance value L1 and the second luminance value L2. The multiplexer 226 selects one from among the first luminance value L1 and the second luminance value L2 thus received, according to a selection signal SEL2. The timing generator 228 controls the multiplexer 226 based on the sub data S3 and the segment data S4. For example, the timing generator 228 converts a sub image represented by the sub data S3 into a raster image, in synchronization with a pixel clock $CLK_{PIX}$. Such an arrangement requires only a simple configuration to convert such a segment character into a raster image. It should be noted that the configuration of the segment decoder 220 is not restricted to such an arrangement.

Figure 7A:
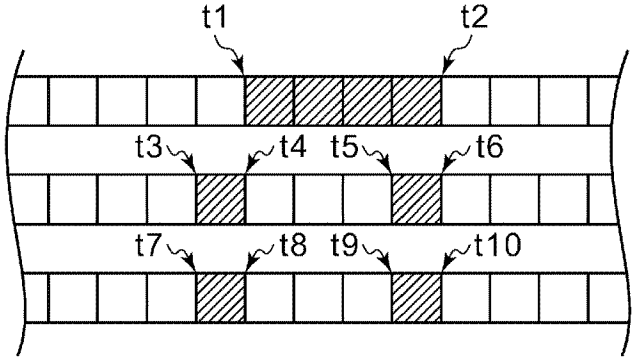
FIGS. 7A and 7B are operation waveform diagrams each showing the operation of the segment decoder shown in FIG. 6.
Figure 7B:
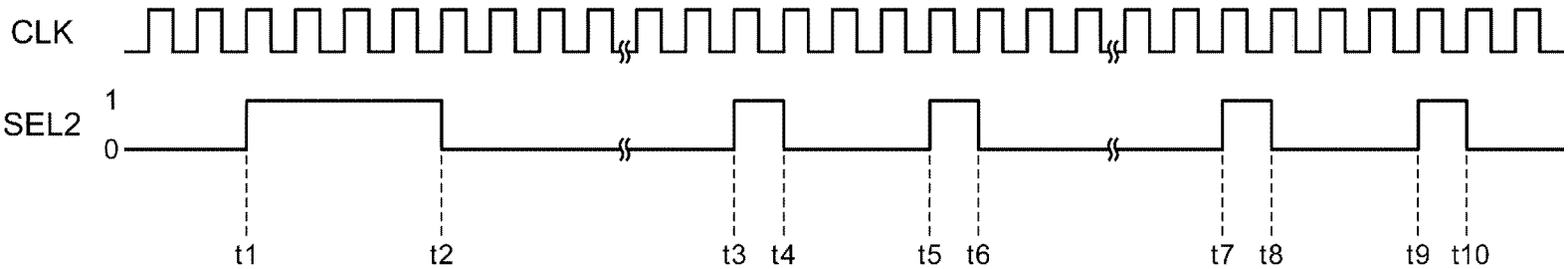

FIGS. 7A and 7B are operation waveform diagrams each showing the operation of the segment decoder 220 shown in FIG. 6. FIG. 7A shows the pixels PIX that form three lines ($L_i$, $L_{i+1}$, $L_{i+2}$) to be displayed on the display panel 102. Each pixel included in a segment that is to be turned on is shown in black. The timing controller 200 generates RGB data from left-hand pixels to right-hand pixels in every line, from upper lines to lower lines, in synchronization with the pixel clock $CLK_{PIX}$. As shown in FIG. 7B, the timing generator 228 generates the selection signal SEL2 in synchronization with the pixel clock $CLK_{PIX}$, so as to generate the sub image based on the sub data S3.

Next, description will be made regarding the segment data S4. With the height of the segment character 800 as Y pixels, and with the width thereof as X pixels, each character is represented by an image including (X×Y) pixels. Accordingly, each segment data S4 can be represented by (X×Y)-bit data (in a case in which data compression as described later is not performed). However, the memory capacity required to store the segment data S4 increases according to an increase in the number of pixels that represent each character. As an example, in a case in which Y=521 and X=380, such an arrangement requires a ROM capacity of (521×380) bits for each segment data. That is to say, such an arrangement requires a ROM capacity of (16×521×380) bits to store all the segment characters A through P.

In order to solve such a problem, the segment character 800 shown in FIG. 3A is designed to have multiple segments that can be classified into groups, each of which is associated with a common shape. For example, the segments A, B, P, L, E, and F classified into a first group have a common shape and a position relation in which each segment can be obtained by shifting any one of the other segments in the same group. The segments H, J, C, G, N, and D classified into a second group have another common shape. The segments I and M classified into a third group have a yet another common shape. The segments O and K classified into a fourth group have a yet another common shape.

In order to represent a segment classified into a group including two or more segments having the same shape, the segment data S4 may comprise shape data S7 that represents the shape of the segment and shift data S6 that represents the shift data. Such an arrangement allows the segment data amount to be dramatically compressed, thereby allowing the circuit area of the timing controller to be reduced.

Figure 8A:
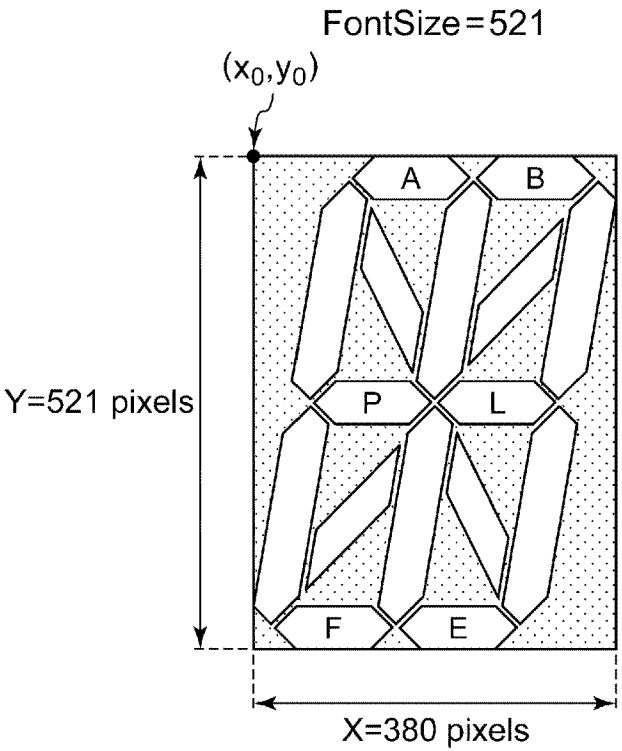
FIGS. 8A through 8C are diagrams for explaining segment data compression.
Figure 8B:
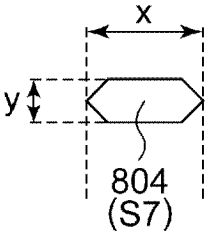
Figure 8C:
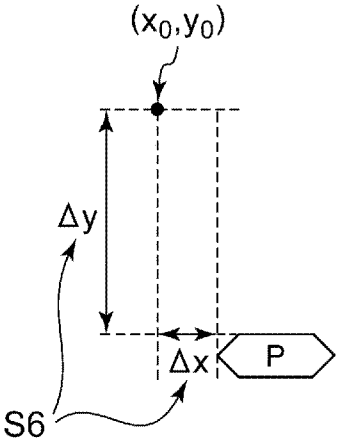

FIGS. 8A through 8C are diagrams for explaining the segment data compression. Description will be made below directing attention to the first group. FIG. 8A shows an example of a segment character 800 having a font size of 521 (height Y=512 pixels and width X=380 pixels). FIG. 8B shows a common member 804 of the segments A, B, P, L, E, and F, having the same shape, and classified into the first group. The common member 804 has a height of y pixels ($y<Y$) and a width of x pixels ($x<X$), which can be represented by ($x \times y$)-bit data. For example, in a case in which x=130 pixels and y=45 pixels, the shape data S7 is configured as ($130 \times 45$)-bit data.

Each of the segments A, B, P, L, F, and E can be represented by the common shape data S7 shifted by $\Delta x$ in the horizontal direction and by $\Delta y$ in the vertical direction from a given reference position ($x_0$, $y_0$). FIG. 8C shows the shift for the segment P. The segment P can be shifted by up to X=380 pixels in the horizontal direction, and can be shifted by up to Y=521 pixels in the vertical direction. Thus, the data S6 that represents the shift amount for each segment is configured as (X+Y)-bit data at most.

That is to say, the segment data amount with respect to the first group including the segments A, B, P, L, F, and E is represented by the sum of: (i) the data amount of the common shape data S7 ($x \times y$ bits) of the multiple segments; and (ii) the data amount represented by multiplying the number of segments (six) by the shift data S6 (X+Y) for each segment. That is so say, in a case of employing such segment data compression, the data amount Z required to represent the segment data that belongs to the first group is represented by $Z=x \times y+6 \times (X+Y)$ bits.

In contrast, in a case in which such segment data compression is not employed, the data amount Z' required to represent the segment data that belongs to the first group is represented by $Z=(X \times Y) \times 6$.

In a case in which X=380, Y=521, x=130, and y=45, when the segment data compression is employed, such an arrangement requires the data amount Z of 11,256 bits. In contrast, when such segment data compression is not employed, such an arrangement requires the data amount Z' of 1,187,880 bits. That is to say, such segment data compression allows the segment data amount to be compressed to 1% or less.

The segment data compression is also applicable to the second group through the fourth group in the same way as the first data. It should be noted that the data format of the segment data is not restricted to such an arrangement described above.

Figure 9A:
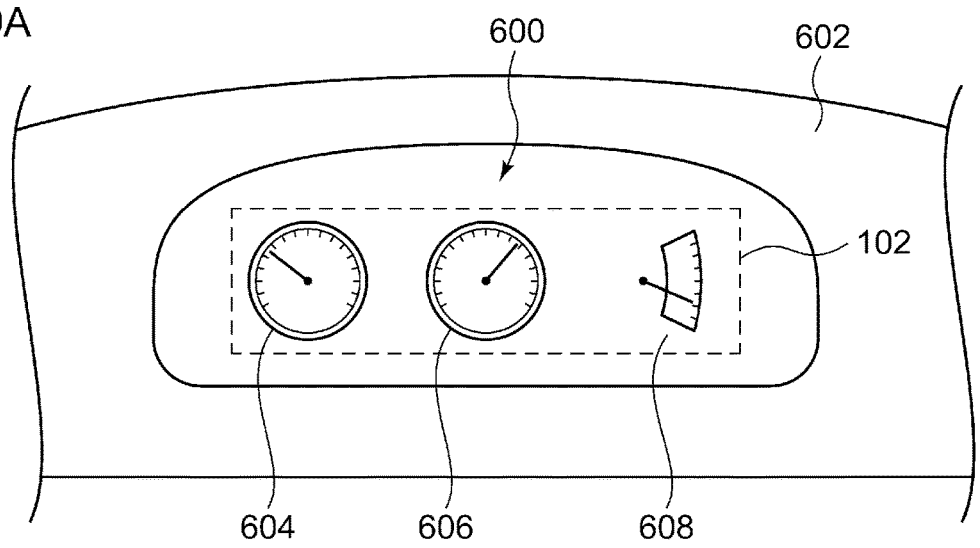
FIGS. 9A and 9B are diagrams each showing an in-vehicle display apparatus employing the timing controller.
Figure 9B:
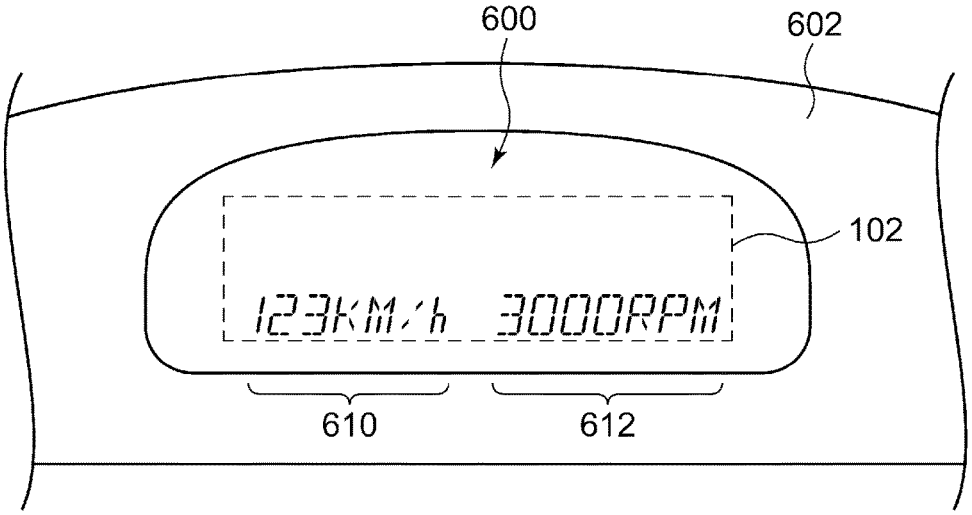

Lastly, description will be made regarding the usage of the timing controller 200. FIGS. 9A and 9B are diagrams each showing an in-vehicle display apparatus 600 employing the timing controller 200. The in-vehicle display apparatus 600 is embedded in a console 602 in front of a cockpit. The in-vehicle display apparatus 600 receives the input image data S1 to be displayed from a vehicle-side processor, and displays a speedometer 604, a tachometer 606 that indicates the rotational speed of an engine, and a remaining fuel meter 608, based on the input image data S1. In a case in which the vehicle is configured as a hybrid vehicle or an electric vehicle, the input image data S1 further includes the remaining battery charge data, and the timing controller 200 further displays a remaining battery charge gauge based the image data S1 (FIG. 9A).

When a situation has occurred in which the input image data S1 cannot be displayed via the in-vehicle display apparatus 600, a blackout state occurs in the display panel 102, leading to difficulty in driving the vehicle. In a case in which the timing controller 200 is mounted on the in-vehicle display apparatus 600, in a situation in which the input image data S1 cannot be displayed, such an arrangement generates the sub data S3 that represents substitution information (for displaying a vehicle speed display 610, an engine rotational speed display 612, a remaining fuel display, a remaining battery charge display, etc.). By inputting the sub data S3 thus generated to the in-vehicle display apparatus 600, such an arrangement allows useful information to be displayed in a real-time manner using the segment characters. This provides improved safety.

Also, when the in-vehicle display apparatus 600 is started up after the user switches on the ignition, such an arrangement allows a given character string such as "PLEASE WAIT . . . ", a character string that represents the current time, or the like, to be displayed in the form of the sub image data S5 before the input image data S1 can be displayed.

Also, the timing controller 200 may be employed in a medical display apparatus. The medical display apparatus displays necessary information for medical doctors and nurses in a medical examination, medical treatment, or surgery. The timing controller 200 allows such a medical display apparatus to display important information (e.g., the heart rate, blood pressure, and the like, of the subject) in the form of the sub image data S5 even in a situation in which the input image data S1 cannot be displayed.

Figure 10:
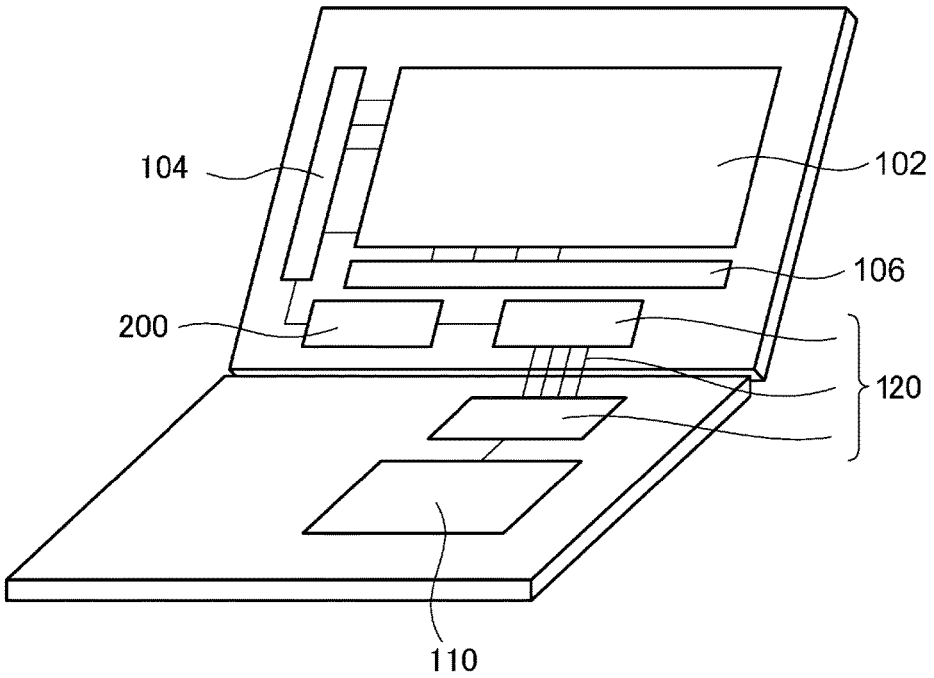
FIG. 10 is a perspective view showing an electronic device.

FIG. 10 is a perspective view showing an electronic device 500. The electronic device 500 shown in FIG. 10 may be configured as a laptop PC, a tablet terminal, a smartphone, a portable game machine, an audio player, or the like. The electronic device 500 includes a graphic controller 110, a display panel 102, a gate driver 104, and a source driver 106, each of which is built into a housing 502. A transmission apparatus 120 may be arranged between the timing controller 200 and the graphic controller 110, and may include a differential transmitter, a propagation path, and a differential receiver.

Description has been made above regarding the present invention with reference to the embodiment. The above-described embodiment has been described for exemplary purposes only, and is by no means intended to be interpreted restrictively. Rather, it can be readily conceived by those skilled in this art that various modifications may be made by making various combinations of the aforementioned components or processes, which are also encompassed in the technical scope of the present invention. Description will be made below regarding such modifications.

[First Modification]

Figure 11:
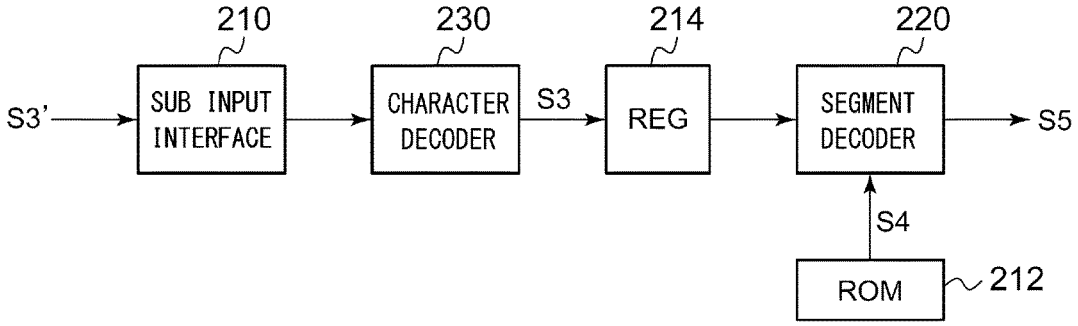
FIG. 11 is a block diagram showing a part of a timing controller according to a first modification.

The data format of the sub data S3 is not restricted to such an arrangement described in the embodiment. FIG. 11 is a block diagram showing a part of a configuration of a timing controller 200*a* according to a first modification. In this modification, the sub data S3' received from the graphic controller 110 includes a character code that specifies a segment character. The character code thus employed may be configured as an ASCII (American Standard Code for Information Interchange) code. The segment decoder 220 of the timing controller 200*a* further includes a character decoder 230 that converts a given character code into multiple bits that indicate the on/off states of the multiple segments.

With such a modification, the characters and symbols that can be employed are restricted to standard numerals and alphabetic characters. However, such a modification allows the user to specify a desired character code to be displayed without concern for the segment shape and the like.

[Second Modification]

Figure 12:
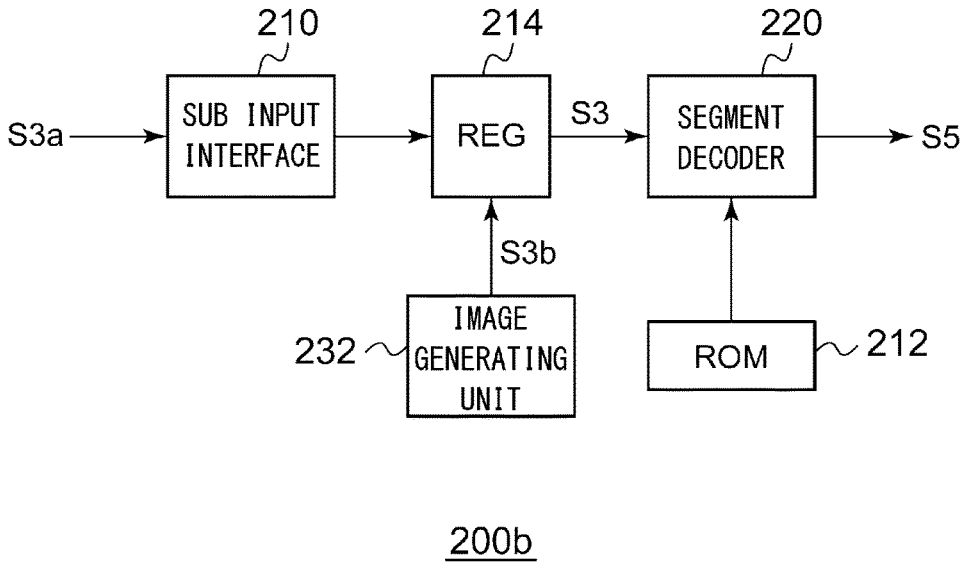
FIG. 12 is a part of a timing controller according to a second modification.

FIG. 12 is a block diagram showing a part of a configuration of a timing controller 200*b* according to a second modification. The timing controller 200*b* further includes an image generating unit 232 that generates local sub data S3*b*. The image generating unit 232 writes the sub data S3*b* to the register 214. The sub data to be written to the register 214 is selected from among the external sub data S3*a* input to the sub input interface 210 from an external circuit and the local sub data S3*b* generated by an internal component of the timing controller 200*b*. The sub data thus selected is written to the register 214. The segment decoder 220*b* converts a given segment character into a raster image based on the sub data written to the register 214. This allows debug information and error information with respect to the timing controller 200*b* itself to be displayed.

[Third Modification]

The configuration of the sub input interface 210 is not restricted to such a register access-type configuration. For example, the sub input interface 210 may be configured to employ differential serial transmission as with the first line 112. Also, the sub input interface 210 may be designed as a desired interface.

[Fourth Modification]

Description has been made in the embodiment regarding an arrangement in which the multiple segment characters 800 that form the sub image 900 each have a fixed font size and position. However, the present invention is not restricted to such an arrangement. For example, each segment character 800 may have a font size that can be selected from among multiple font sizes. In this case, the segment data S4 may preferably be prepared for each font size, and the sub data S3 may preferably include additional data for specifying the font size.

Also, an arrangement may be made which is capable of specifying the drawing position for each of the multiple segment characters 800. That is to say, an arrangement may be made which is capable of changing the coordinate position for each of the multiple regions R1 through RN. In this case, the sub data S3 may include data that indicates the character interval. Description has been made with reference to FIG. 4A regarding an arrangement in which the sub image 900 is configured as a single line. Also, the sub image 900 may be configured as multiple-line text.

In addition, the sub data S3 may include a parameter that indicates the alignment in the height direction for each of the multiple segment characters 800 to be drawn on a single line, examples of which include the bottom alignment, top alignment, center alignment, and the like.

Also, the sub data S3 may further include third data that indicates the transparency of the segment character.

[Fifth Modification]

In a case in which the sub image is displayed as a superimposed image on a main image configured as a background, a pixel sequence that corresponds to the main image may be input as the second luminance value L2 shown in FIG. 6.

[Sixth Modification]

Description has been made in the embodiment regarding an arrangement employing such 16-segment characters. However, the present invention is not restricted to such an arrangement. Also, 14-segment characters may be employed (the segments A and B shown in FIG. 3A are configured as a single segment, and the segments E and F are configured as a single segment). Also, 7-segment characters may be employed (each comprising segments A, H, J, P, G, N, F shown in FIG. 3A).

[Seventh Modification]

Figure 13A:
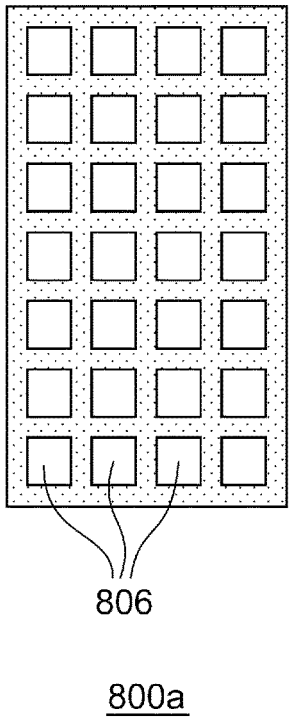
FIGS. 13A and 13B are diagrams each showing a segment character according to a seventh modification.
Figure 13B:
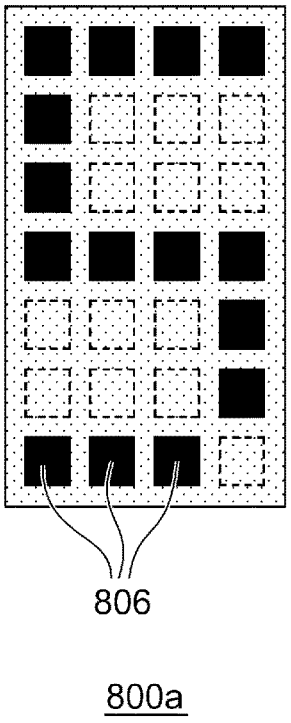

FIGS. 13A and 13B are diagrams each showing a segment character according to a seventh modification. Such a segment character 800*a* is configured as a dot-matrix character formed of multiple dots 806. FIG. 13 shows a (4×7)-dot matrix. However, the number of dots in each of the vertical direction and horizontal direction is not restricted in particular. It can be assumed that the multiple dots 806 are equivalent to the multiple segments 802. It should be noted that each dot 806 is not equivalent to a single pixel of the display panel 102. Rather, each dot 806 includes multiple pixels. The shape of each dot 806 is not restricted to such a rectangular shape. Also, each dot 806 may have other shapes such as a circular shape, a rhombic shape, an octagonal shape, or the like.

The memory 212 stores multiple segment data each of which specifies the on/off states of the pixels on an image frame for each of the multiple dots 806. With such a dot-matrix character, the multiple dots 806 may be configured to have the same shape. Such an arrangement allows the segment data to be compressed using the method described with reference to FIGS. 8A through 8C.

Each (4×7)-dot matrix character can be represented by 28-bit data. Accordingly, by preparing a 4-byte (32-bit) register (214 in FIG. 2) for each character, such an arrangement is capable of uniquely specifying a given character or symbol to be displayed.

[Eighth Modification]

FIGS. 14A and 14B are diagrams each showing a segment character according to an eighth modification. FIG. 14A shows "A" as an upper-case letter of the alphabet. FIG. 14B shows "C" as an upper-case letter of the alphabet. In this modification, each segment character is configured as a combination of multiple types of segments (four types in this example, i.e., segment types A through D). The shape of each segment is not restricted to such a rectangular shape.

In this modification, the aforementioned multiple segment data S4 correspond to the multiple types of segments. Each segment data S4 specifies the shape of the corresponding segment type (which is represented by the on/off states of the pixels on the image frame, for example).

In this modification, the data for representing each segment character includes: (i) type data that specifies the segment type for each of the multiple segments to be used; and (ii) position data that specifies the position of each of the multiple segments to be used.

Description will be made with description data that represents a given character "#" as S30[#]. FIG. 15A is a diagram showing description data S30[A] that represents the segment character "A" shown in FIG. 14A. FIG. 15B is a diagram showing description data S30[C] that represents the segment character "C" shown in FIG. 14B.

The segment character 300 shown in FIG. 14A is formed of eight segments 301 through 308. Accordingly, the description data S30[A] thereof includes type data S31 that specifies the respective types of the eight segments 301 through 308 and position data S32 that specifies the respective positions of the eight segments 301 through 308. The position may be represented by the coordinate position of the upper-left corner of each segment or otherwise any one of the other corners.

A segment character 400 shown in FIG. 15A is formed of eight segments 401 through 408. Accordingly, the description data S30[C] thereof includes the type data S31 that specifies the respective types of the eight segments 401 through 408 and the position data S32 that specifies the respective positions of the eight segments 401 through 408.

The description data S30 may preferably be defined for each character to be used. For example, the upper-case letters of the alphabet "A" through "Z" may be represented by defining 26 sets of description data S30[A] through S30[Z]. Also, the lower-case letters of the alphabet "a" through "z" may be represented by defining 26 sets of description data S30[*a*] through S30[*z*]. Also, the numerals "0" through "9" may be represented by defining ten sets of description data S30[0] through S30[9]. In addition, Greek letters, Japanese hiragana characters, Japanese katakana characters, and Chinese characters, may be defined.

Figure 16:
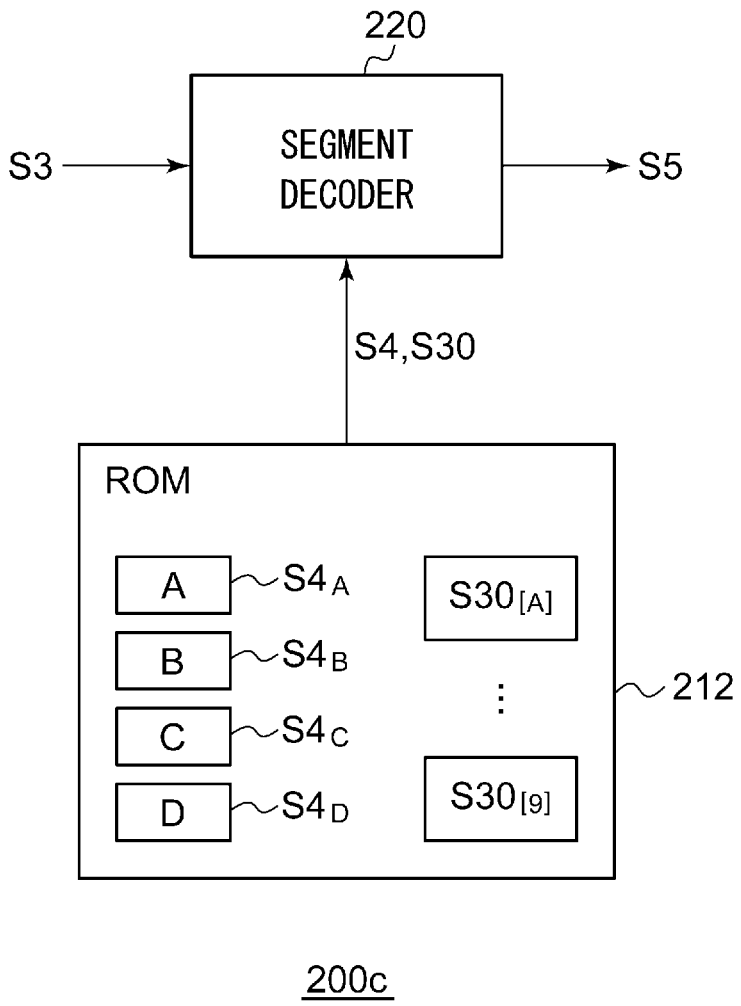
FIG. 16 is a diagram showing a part of a timing controller according to the eighth modification.

FIG. 16 is a diagram showing a part of a timing controller 200*c* according to an eighth modification. The memory 212 stores the type data S30 defined for each segment character in addition to the segment data S4 defined for each segment type. The segment decoder 220 receives the sub data S3 that specifies the segment character to be displayed, and reads out the description data S30 that corresponds to the segment character to be displayed.

For example, when the sub data S3 indicates an instruction to display the letter of the alphabet "A", such an arrangement assigns a segment of the type A to the coordinate position (x1, y1) as the segment 301 based on the type data S30[A] shown in FIG. 15A. In the same way, such an arrangement assigns a segment of the type A to the coordinate position (x2, y2) as the segment 302. Such an arrangement allows desired characters and symbols to be displayed.

While the preferred embodiments of the present invention have been described using specific terms, such description is for illustrative purposes only, and it is to be understood that changes and variations may be made without departing from the spirit or scope of the appended claims.

What is claimed is:

1. A timing controller comprising:

a main input interface structured to receive input image data;

memory structured to store a plurality of segment data that correspond to a plurality of respective segments that form a segment character, wherein each segment data specifies on/off states of pixels that correspond to the corresponding segment on an image frame;

a sub input interface structured to receive sub data that specifies the segment character to be displayed;

a segment decoder structured to generate the segment character in the form of a raster image based on the sub data and the plurality of segment data;

an image processing circuit structured to generate output image data to be displayed on a display panel, based on at least one from among the input image data and output data of the segment decoder; and an output interface structured to output the output image data to a data driver;

wherein the segment character comprises a plurality of segments designed such that two or more segments have a common shape, and wherein the segment data of the aforementioned two or more segments having the common shape comprises shape data that specifies a shape of the segment and data that specifies a shift amount by which the segment is to be shifted in a vertical direction and a horizontal direction.

2. The timing controller according to claim 1, wherein the segment decoder comprises:

a multiplexer structured to receive a segment luminance value that corresponds to the on state and a background luminance value that corresponds to the off state, and to select one from among the segment luminance value and the background luminance value thus received; and a timing generator structured to control the multiplexer according to the sub data and the segment data.

3. The timing controller according to claim 1, wherein the image processing circuit selects one from among the input image data and the output data of the segment decoder so as to generate the output image data.

4. The timing controller according to claim 1, wherein the image processing circuit is structured to combine the input image data and the output data of the segment decoder so as to generate the output image data.

5. The timing controller according to claim 1, wherein the image processing circuit is structured to switch between:

(i) a mode in which data is selected from among the input image data and the output data of the segment decoder so as to generate the output image data; and (ii) a mode in which the input image data and the output data of the segment decoder are combined so as to generate the output image data.

6. The timing controller according to claim 1, wherein the sub data comprises a plurality of bits that specify the on/off states of the plurality of respective segments, and wherein the sub input interface comprises a register structured to store the plurality of bits.

7. The timing controller according to claim 1, wherein the sub data comprises a character code that specifies the segment character, and wherein the timing controller further comprises a character decoder structured to convert the character code into a plurality of bits that specify the on/off states of the plurality of respective segments.

8. The timing controller according to claim 1, wherein the sub input interface is configured as an SPI (Serial Peripheral Interface) or otherwise an I2C (Inter-Integrated Circuit) interface.

9. The timing controller according to claim 1, wherein the sub data further comprises first data that specifies a size of the segment character.

10. The timing controller according to claim 1, wherein the sub data further comprises second data that specifies an interval between segment characters.

11. The timing controller according to claim 1, wherein the sub data further comprises an indication of transparency of the segment character.

12. The timing controller according to claim 1, wherein the segment decoder is structured to select one from among the sub data input to the sub input interface from an external circuit and the sub data generated by an internal component of the timing controller, and to generate the segment character in the form of a raster image based on the sub data thus selected.

13. The timing controller according to claim 1, monolithically integrated on a single semiconductor substrate.

14. A display apparatus structured as an in-vehicle display apparatus or otherwise as a medical display apparatus, comprising the timing controller according to claim 1.

15. An electronic device comprising the timing controller according to claim 1.

* * * * *